US005802967A

United States Patent [19]

Thudium et al.

[11] Patent Number: 5,802,967

[45] Date of Patent: Sep. 8, 1998

[54] ARRANGEMENT FOR TRANSFERRING WORKPIECES THROUGH A SUCCESSION OF MACHINING STATIONS

[75] Inventors: Karl Thudium, Waeschenbeuren; Walter Rieger, Goeppingen; Andreas Dangelmayr, Ottenbach, all of Germany

[73] Assignee: Schuler Pressen GmbH & Co., Germany

[21] Appl. No.: 605,630

[22] Filed: Feb. 22, 1996

[30] Foreign Application Priority Data

Feb. 22, 1995 [DE] Germany ..... 195 06 078.4

[51] Int. Cl.[6] ..... B30B 15/30; B21D 43/05

[52] U.S. Cl. ..... 100/207; 72/405.13; 198/621.1; 414/751

[58] Field of Search ..... 100/207, 215, 100/218; 72/405.11, 405.13, 405.16; 198/621.1–621.4; 414/751

[56] References Cited

U.S. PATENT DOCUMENTS 4,785,657 11/1988 Votava ..... 198/621.1

5,566,814 10/1996 Hofele ..... 72/405.16

FOREIGN PATENT DOCUMENTS 0616859 9/1994 European Pat. Off. ..... 72/405.13

4309642 9/1994 Germany ..... 72/405.13

4310057 9/1994 Germany ..... 72/405.13

*Primary Examiner*—Stephen F. Gerrity

*Attorney, Agent, or Firm*—Evenson, McKeown, Edwards & Lenahan, P.L.L.C.

[57] ABSTRACT

An arrangement is used for transferring workpieces through a succession of machining stations of a press, a simulator or similar machining system or tool setting system. This arrangement has two spaced transport rails which are arranged parallel to one another and which can be moved by motors horizontally in a longitudinal direction thereof, vertically up and down and horizontally toward one another. Each individual transport rail is pivotally connected for a horizontal movement in each case by way of a coupling rod. Traverses are operatively connected by way of at least one of the coupling rods with one respective transport rail. The traverses can be moved by an additional transverse drive which is synchronously driven by the driving motors arranged in a closing box of the press for the horizontal movement of the transport rails toward one another.

6 Claims, 3 Drawing Sheets

ARRANGEMENT FOR TRANSFERRING WORKPIECES THROUGH A SUCCESSION OF MACHINING STATIONS

BACKGROUND AND SUMMARY OF THE INVENTION

The present invention relates to an arrangement for transferring workpieces through a succession of machining stations, and more particularly, to a workpiece transfer system comprising spaced parallel transport rails, at least one motor for moving the transport rails horizontally in a longitudinal direction thereof, vertically up and down and horizontally toward and away from one another, a respective coupling rod for moving each of the transport rails horizontally.

Transfer devices are used in presses, transfer presses, press lines for transferring workpieces, but also in simulators for tooling a press. A separate control of the transport rails is required in two or three axes.

In practice, the known arrangement uses at least one motor which acts directly for the moving drive of the transport rails in their longitudinal direction by at least one motor, and, when a transmission is used, which acts indirectly, upon a gear wheel. When a toothed belt is used, the motor acts on a deflection wheel, in which case the gear wheel interacts with a toothed rack extending in the longitudinal direction of the transport rail and the deflection wheel interacts with a toothed belt extending in the longitudinal direction of the transport rail, on the toothed rack or on the toothed belt. A tapping point is formed in an area away from the transport rails. In the tapping point, a coupling rod with an end piece is pivotally connected, the other end piece being pivotally connected with the transport rail.

It is a disadvantage of the known arrangement that the different movements of the transport rails are mechanically coupled which results in a relatively high-expenditure mounting of the entire arrangement and in a relatively large number of moved masses.

In the case of modern presses, the driving devices for the individual moving directions of the transport rails are electrically coupled with one another, thereby eliminating a high-expenditure mechanical coupling. Even here, however, it is a disadvantage that the driving devices provided for the transverse movement of the transport rails, simultaneously must also displace the driving devices provided on cross traverses for the movement of the transport rails in the longitudinal direction. This requires that the driving devices for the transverse movement of the transport rails must have a stronger design.

Another problem which occurs in known arrangements is a possible tilting of the cross traverses in their guide rails. As a result, perfect, mainly no-jolt and, therefore, precise movement of the transport rails cannot be ensured.

It is, therefore, an object of the present invention to provide an arrangement which does not have the above-mentioned disadvantages, particularly by way of which no-jolt, problem-free movements of the transport rails in the vertical direction, thus transversely to the passage direction of the components through the press, will be achievable.

According to the present invention, this object has been achieved by providing traverses which are operatively connected by at least one coupling rod with a respective transport rail, and a cross drive which is driven synchronously by at least one driving motor for moving the transport rails toward and away from one another.

According to one feature of the present invention, there is provided an additional transverse drive which, synchronously with the driving motors for the horizontal movement of the transport rails, which motors are arranged in a closing box of the press, moves the cross traverses, on which the driving devices for the longitudinal movement of the transport rails are arranged, toward one another. Thereby, a tilting of the cross traverses in their guide rails is prevented.

Advantageously, the present invention ensures that the moving course of the transport rails for receiving, transporting and depositing workpieces can therefore take place without jolts.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
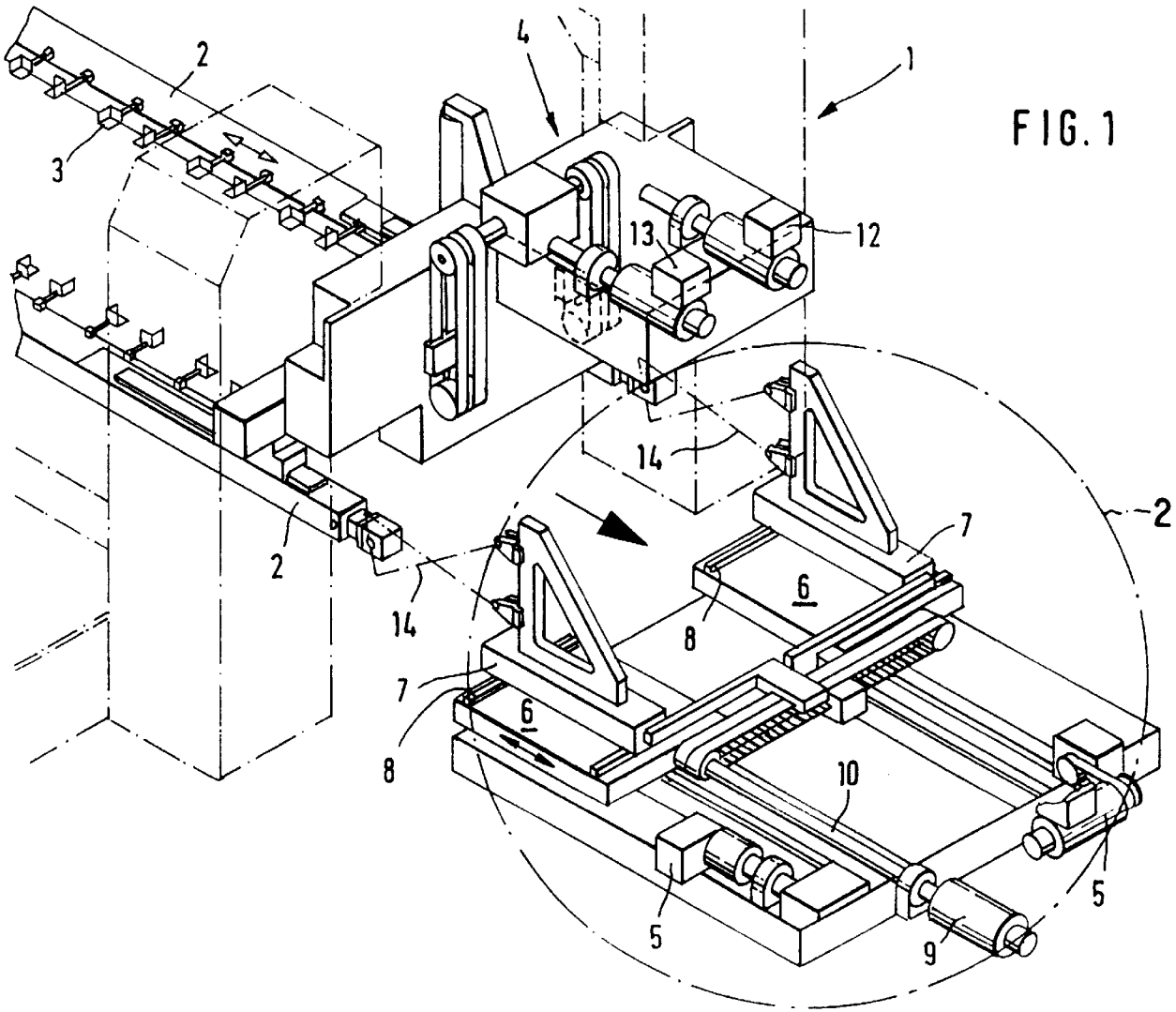
FIG. 1 is a perspective view of an arrangement according to the present invention.

With reference to FIG. 1, a press or a simulator 1 is shown which has transport rails 2 which can be moved in three perpendicular axis directions. The passage direction of workpieces through the press 1 is indicated by an arrow. Known grippers 3, such as tongs, suction devices or the like, are mounted on the transport rails 2.

In closing boxes 4 of the press 1, driving devices are arranged for movements of the transport rails 2 in the transverse direction, i.e., toward one another in the horizontal plane as well as for movements in the vertical direction. Thus, the motor 12 is arranged in the closing box 4 of the press 1 and is used as a driving device for moving the transport rails 2 toward one another. Another motor 13 is also arranged in the closing box 4 for moving the transport rails 2 in the vertical direction.

The longitudinal movements of the transport rails 2, i.e. movements parallel to the conveying direction of workpieces, are carried out by driving devices 5 which move carriages 6 which can be displaced in linear guides parallel to the passage direction.

On the carriages 6, traverses 7 are arranged which can be displaced in the transverse direction, i.e. transversely to the workpiece passage direction and which, by way of suitable devices which in the illustrated embodiment are constructed as coupling rods 14, are connected with the transport rails 2. The coupling rods 14 are shown schematically and can, for example, be constructed as double-armed brackets. The traverses 7 are disposed in linear guides 8.

The drive of the traverses 7 takes place by way of an additional transverse drive 9 which, by way of a shaft 10, drives a torque transmitting device 11 (FIG. 2) which, in the illustrated embodiment, is constructed as a toothed belt. The traverses 7 is fastened on the toothed belt 11 in the suitable known manner.

In order to permit a synchronized movement of the traverses 7 toward one another, one of the traverses, by way of a suitable device, is fixedly connected with the toothed belt 11 while another of the traverses 7 is fastened on an area of the toothed belt 11 which first extends via a deflection so that the two areas of the toothed belt are arranged to extend parallel to one another and substantially horizontally. If now, by way of the transverse drive 9, the shaft 10 is rotated, the traverses 7 move toward or away from one another.

This movement of the cross traverses 7 takes place synchronously with the motor 12, which is arranged in the closing box 4 and was mentioned above, for driving the transport rails 2 in the transverse direction, in which case the synchronization is implemented by way of the driving devices for the individual axes. Thus, tilting of the cross traverses 7 occur in the linear guides 8 which would otherwise cause jolt-type movements of the transport rails 2 is avoided.

The torque transmitting device, which in the above-described embodiment is constructed as a toothed belt, may, of course, also have a different construction, for example, that of a chain, a worm drive or a rack-and-pinion drive. Generally, any suitable device may be used for converting a rotating movement to a linear movement.

Figure 2:
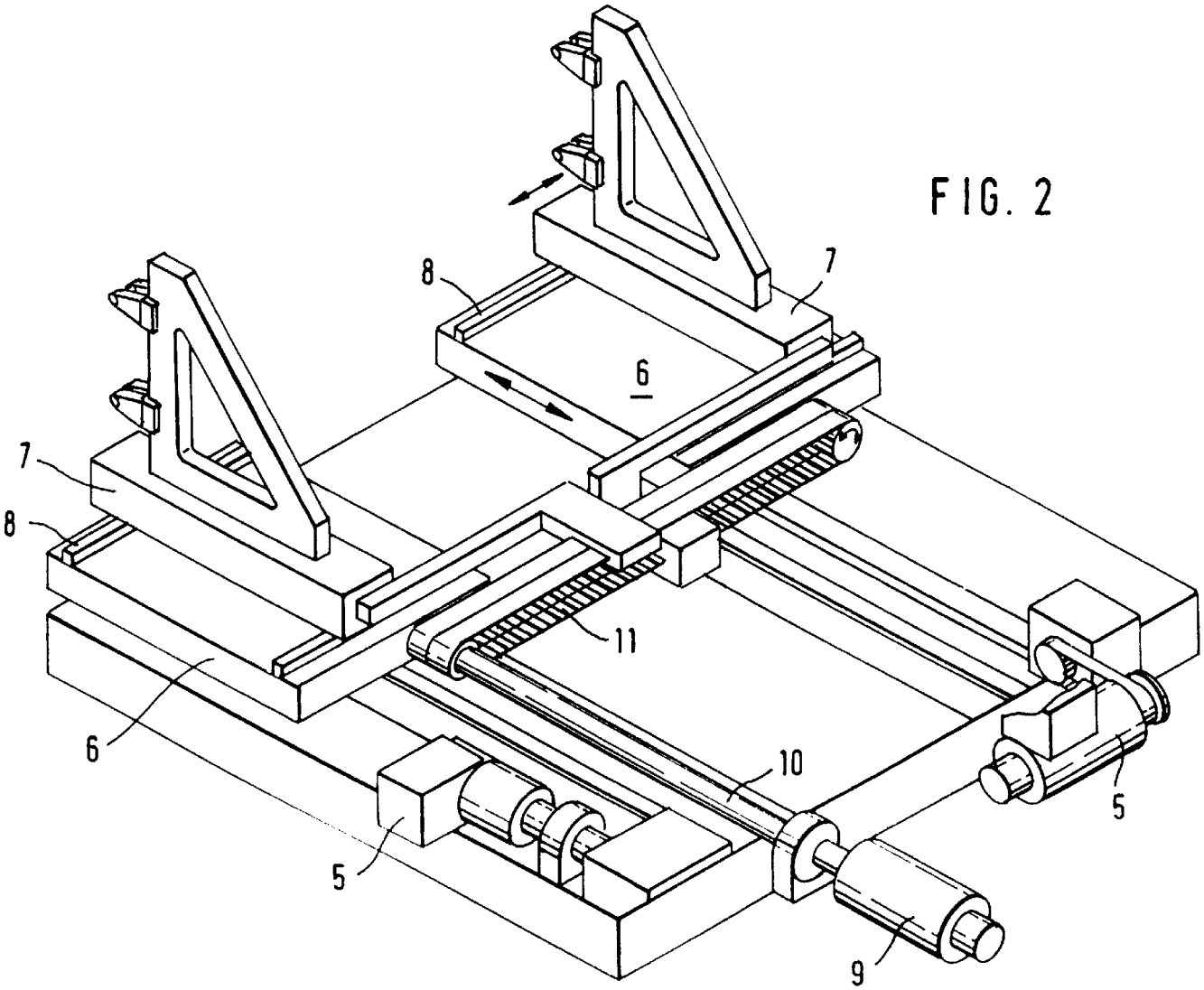
FIG. 2 is an enlarged representation of the detail II shown in dash-dot circle of FIG. 1.
Figure 3:
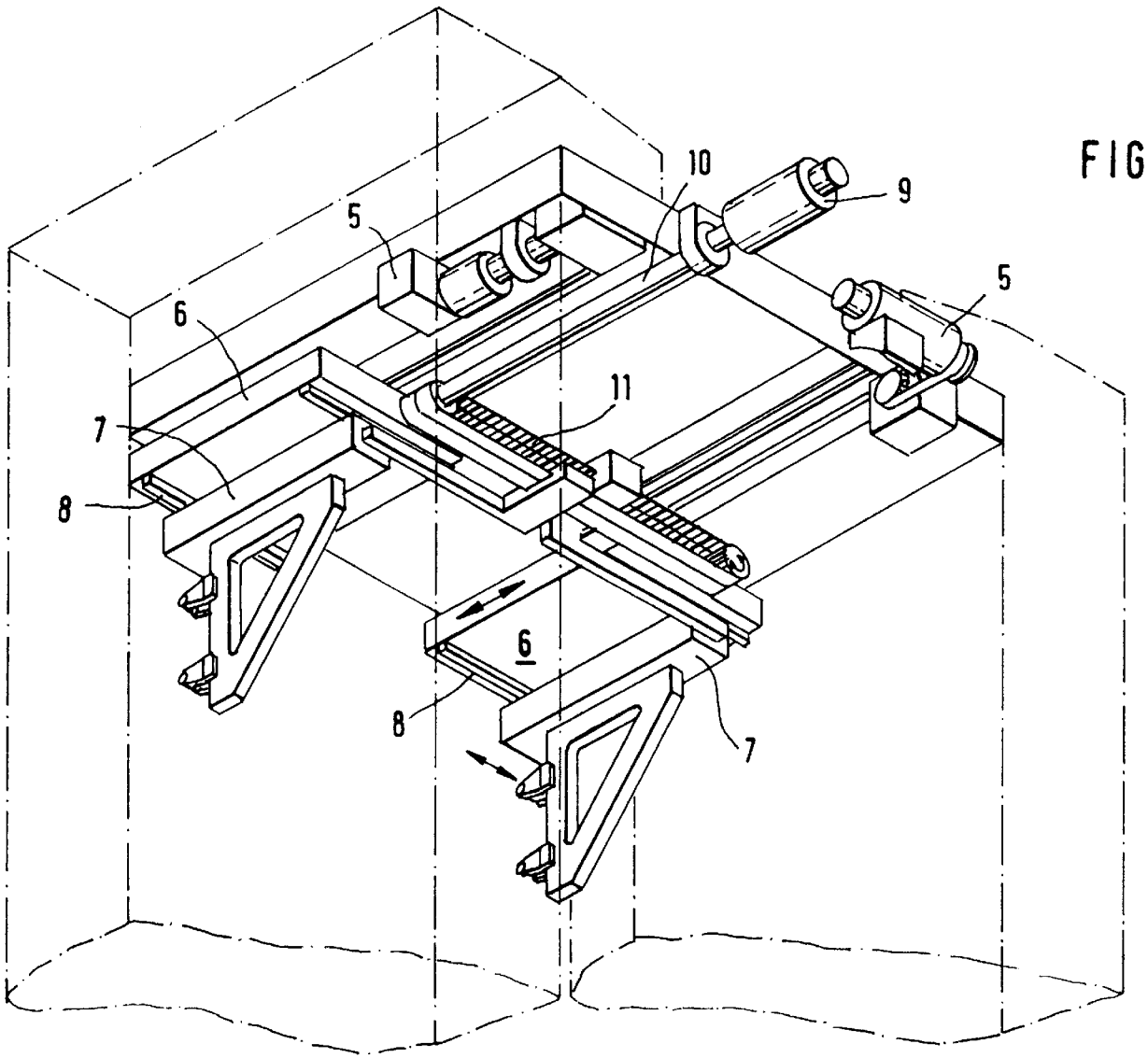
FIG. 3 is a view of arrangement of FIG. 1 mounted on a suspended closing box.

FIG. 3 illustrates placement of the arrangement of FIG. 2 on a suspended closing box of a press or of a simulator. The above-mentioned advantages and the method of operation of the arrangement also apply to the arrangement according to FIG. 3. Moreover, the arrangement of FIG. 2 can also be used, if required, in two-axis transfer systems.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An arrangement for transferring workpieces through a succession of machining stations of one of a press, a simulator, and a tool setting system, comprising: spaced parallel transport rails; at least one motor for moving the transport rails horizontally in a longitudinal direction thereof, vertically up and down and horizontally toward and away from one another; a respective coupling rod for moving each of the transport rails; traverses each operatively connected by at least one of said coupling rods with a respective transport rail, and a cross drive driven synchronously with the at least one driving motor for moving the traverses and respective transport rails toward and away from one another.

2. The arrangement according to claim 1, wherein the traverse drive drives a torque transmitting device to move the traverses.

3. The arrangement according to claim 2, wherein the torque transmitting device is a toothed belt.

4. The arrangement according to claim 2, wherein the torque transmitting device is a chain drive.

5. The arrangement according to claim 2, wherein the torque transmitting device is a worm drive.

6. The arrangement according to claim 2, wherein the torque transmitting device is a rack-and-pinion rack drive.

* * * * *